United States Patent [19]

Barber

[11] 3,986,702

[45] Oct. 19, 1976

[54] BUILDING JACK APPARATUS

[76] Inventor: Alan T. Barber, P.O. Box 987, Zephyrhills, Fla. 33599

[22] Filed: Sept. 22, 1975

[21] Appl. No.: 615,601

[52] U.S. Cl. ..... 254/45

[51] Int. Cl.[2] ..... B66F 7/26

[58] Field of Search..... 254/45, 93 R; 214/390, 214/392, 512, 515; 52/745, 79, 125

[56] References Cited

UNITED STATES PATENTS

| | | | |
|---|---|---|---|
| 2,611,579 | 9/1952 | Guzey et al. | 254/93 R |
| 3,289,868 | 12/1966 | Miller et al. | 254/45 |
| 3,494,091 | 2/1970 | Turturro et al. | 52/745 |
| 3,541,598 | 11/1970 | Dousset | 254/45 |
| 3,604,166 | 9/1971 | Ciccarelli et al. | 52/745 |
| 3,631,999 | 1/1972 | Walerowski | 214/390 |
| 3,749,363 | 7/1973 | Hauser | 254/45 |
| 3,834,111 | 9/1974 | Acker et al. | 52/745 |

*Primary Examiner*—Al Lawrence Smith
*Assistant Examiner*—Robert C. Watson
*Attorney, Agent, or Firm*—Duckworth, Hobby, Orman, Allen & Pettis

[57] ABSTRACT

A modular building unit jacking system includes a modular building constructed for attaching and supporting special jacks. The jacks can be quickly inserted into a perimeter frame of the modular building unit, and the building unit lifted to a predetermined height where a truck trailer bed can be backed under it. The unit lowered onto the trailer bed. The jacks have an elongated support arm for insertion into an opening in the perimeter frame of the building. The perimeter frame has vertical support columns therein, so that the force from the jack in lifting the building is spread in the perimeter frame and directed into the vertical columns.

4 Claims, 6 Drawing Figures

BUILDING JACK APPARATUS

BACKGROUND OF THE INVENTION

The present invention relates to jacking systems and especially to a fluid jacking system for lifting a modular building unit for placement upon and removal from trailer beds for transporting modular units between sites.

In the past, a great many types of jacks have been provided including hydraulic and pneumatic jacks for lifting a great variety of objects. Jacks have also been used to level and support building, mobile homes, and the like. It has further been suggested to use threaded members for adjusting corners of machinery as well as modular building units.

Recently, a great variety of modular and prefabricated homes have been suggested and built in which factory methods are applied to building the whole house or a portion of a house or other modular unit. After the units are built in a factory, they are loaded on a truck, train, boat or other vehicle for movement to the site where the unit is to be placed. The most common type of modular homes are offshoots of the mobile home manufacturers who began building bigger mobile homes for stationary placement and which were not intended to be moved from place to place. Thus, it became a natural offshoot to utilize the same factory type building techniques to build units very similar to mobile homes but not having the wheel base and the necessary supports for the wheels and simply loading the unit on the truck or trailer with an over-head crane for transportation to the site in which it was going to be permanently placed. At the site the unit can be removed by a portable crane placed on the precise location desired for the unit. Inasmuch as these modular units were of light weight construction they could be easily handled by a small crew for placement on a site and leveling. The units were typically made of lightweight sheet metal along with plywood and might typically include lightweight, high strength construction such as honeycomb materials. These units, however, while suitable for residential or vacation type homes, would not meet the more stringent requirements of commercial buildings, motels, schools, and the like. To overcome this limitation certain modular steel buildings were designed which could meet commercial requirements. These buildings were easily placed in position with cranes but were not only expensive but had low fire ratings inasmuch as high temperatures tended to warp the metal making the entire building unusable.

The present invention is directed towards a jacking system for lifting a modular unit made of concrete or concrete block which is designed to meet the requirements of schools, motels or commercial buildings as well as homes which has a higher fire rating but which is also substantially heavier than previous modular units and which is accordingly more difficult to lift and transport. Thus, the present jacking system provides for a building adapted to accept a series of jacks for lifting the building for placing a truck trailer bed under the building unit. The building then has special designed features for distributing the load of the jacks throughout the building framework so that the heavier concrete block structure can be placed upon a truck for transportation and can be easily removed at the site without the necessity of expensive cranes being moved to a particular site for unloading the modular unit from the truck.

SUMMARY OF THE INVENTION

The present invention relates to building jacks and especially to a building jack system designed to operate with a concrete block modular building unit for lifting the unit, placing the unit on a truck for transportation to a building site and for removing the modular unit from the truck onto the building site. The concrete block modular unit has a movable horizontal perimeter metal base frame adapted to having modular concrete unit built thereon and for lifting this frame with the rest of the modular unit onto a vehicle for movement to a desired location. The base frame has predetermined openings therein. An interconnecting metal framework has members forming a modular unit framework which has the concrete block walls, floor and roof formed thereon and includes vertically extending metal reinforcing members fixedly attached to the base frame at the corners thereof as well as to the upper horizontal frame members. A plurality of hydraulic and pneumatic jacks have elongated arms thereof of a predetermined size to fit into the openings in the perimeter base frame for directing the lifting force of the jacks over a wide portion of the perimeter base frame and into the vertically extending metal reinforcing members. Fluid pressure from the truck or other pneumatic or hydrualic system can be applied to the jacks for lifting the building and for loading the heavy building upon the trailer bed for transportation to a building site while the jacks remain attached to the perimeter base frame. The same jacks can be used to lift the building at the building site for removing the trailer bed and the building can be lowered onto the site then the jacks removed and returned with truck.

BRIEF DESCRIPTION OF THE DRAWINGS

Other objects features an advantage of the present invention will be apparent from the written description and the drawings in which.

DESCRIPTION OF THE PREFERRED EMBODIMENT

Figure 1:
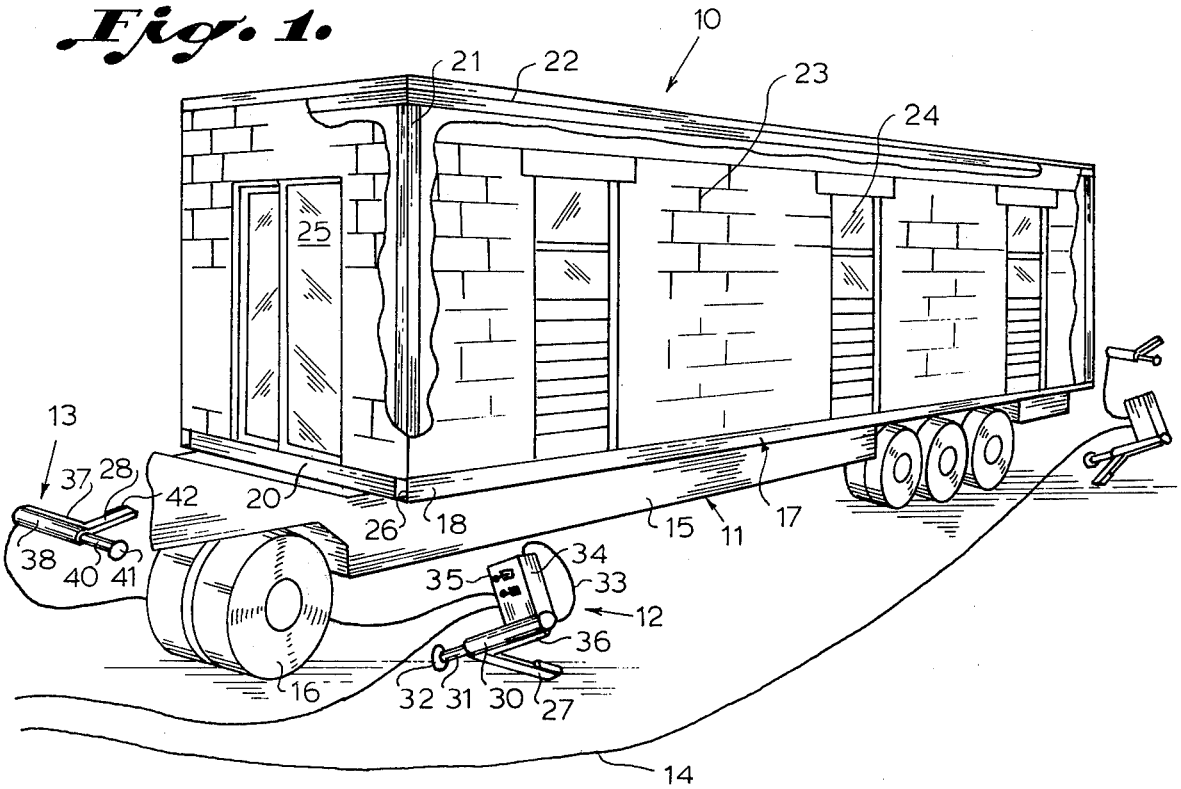
FIG. 1 is a cutaway perspective view of a modular building unit loaded upon a truck trailer bed and the building lifting jacks.
Figure 2:
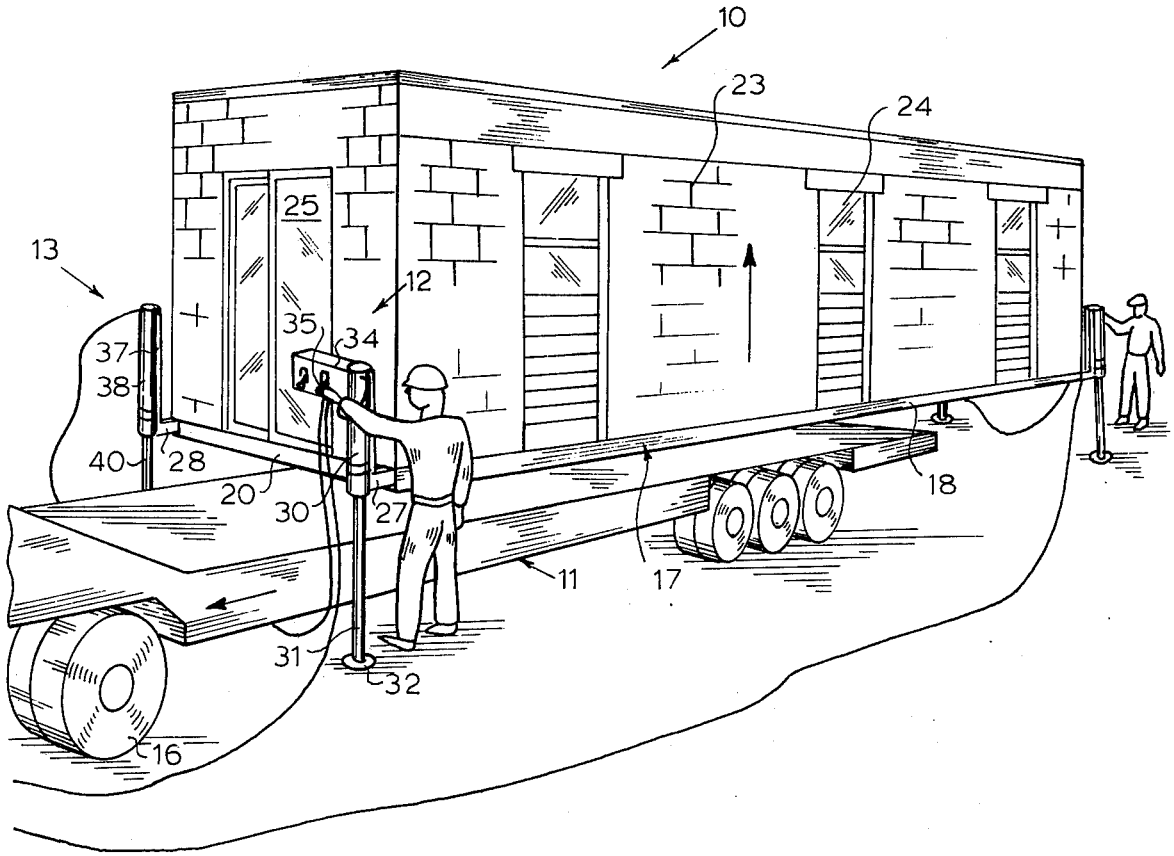
FIG. 2 is a persepctive view of the jacks in accordance with the present invention lifting the modular building unit off of a truck trailer bed.

Referring now to FIGS. 1 and 2 of the drawings, a concrete block modular building unit 10 is illustrated loaded on a truck bed 11 utilizing a pair of jacks 12 and a second pair of jacks 13 connected by pressure hoses 14 to the trucking pneumatic system. Truck bed 11 has the supporting framework 15 and a plurality of wheels 16 and is adapted to receive the building 10. The modular building unit 10 has a perimeter base frame 17 having side steel channels 18 and transverse steel channels 20 welded together to form a perimeter frame to which a reinforced concrete floor has been attached. Vertical frame members 21, which may also be steel channels, have been welded to each corner and at intermediate points as desired. Upper horizontal frame members 22 have been welded to the vertical members 21 so as to evenly spread the large forces to be applied to the frame throughout the framework to give greater rigidity to the building unit. The building unit has concrete block walls 23 which are strong in compression but fairly weak at their joints against tension stresses and in view of their great weight relative to the weakness of the joint in tension, must be held rigid during movement or shifting. The building unit also has a plurality of windows 24 and a sliding glass door 25 along with a roof (not illustrated). A building unit of this great weight, which has inherent weakness during lifting, but great strength when placed on a stationary site requires special handling techniques because of the difficulty in lifting the weight, as well as placing on remote sites. The steel perimeter frame 17 has a plurality of predetermined openings 26 extending into the elongated side members 18 which have been located directly beneath the vertically extended steel columns 21. The openings 26 are adapted to receive elongated jack or lifting arm 27 on the jack 12 and arm 28 on the Jack 3. These are designed to slide into the openings 26 for a snug fit and extending for a sufficient distance into the perimeter frame 18 to spread the jacking forces applied to the arms 27 and 28 over a longer length of the perimeter 17 and also to apply the lifting forces directly to the column 21. The jack 12 has a hydraulic cylinder 30 for driving a jack cylinder rod 31 against a jacking foot 32 and includes a hydraulic line 33 connected to a fluid reservoir 34. Jack 12 also has controls 35 for actuating the jack. The elongated rod 27 is formed in an L shape having a perpendicular member 36 attached thereto and attached to the hydraulic cylinder 30. Similarly, the jack 13 has a vertically extending member 37 attached to the hydraulic cylinder 38 having a jacking rod 40 attached to a foot 41. The jack 13, however, does not have the reservoir 12 nor the controls 35 that is connected directly to the reservoir 34 of jack 12 so that jacks 12 and 13 may be actuated simultaneously by the same controls for lifting both sides of the modular building unit 10 simultaneously by one operator. A set of similar jacks is located on the opposite end of the modular unit 10. The jacks are designed so that the reservoir 34 and controls 35 attached to the jack 12 extend along the side of the building and are sufficiently heavy along with being snug fitting by the shims 42 so that the arms 27 and 28, when inserted in the openings 26, will remain in place without further support as the building is transported from the factory to the building site and then may be easily removed at the building site and returned to the factory in the truck. It should be noted that the bottom of the arm 27 aligns with the bottom of the hydraulic cylinder 30 so that the jack will lower the building unit 10 all the way to the ground as desired and still allow the jacks 12 and 13 to be removed from the perimeter frame 17. FIG. 1 illustrates a building unit 10 placed upon a trailer bed 11 while FIG. 2 illustrates the building unit 10 being lifted off the trailer unit by the jacks 12 and 13.

Figure 3:
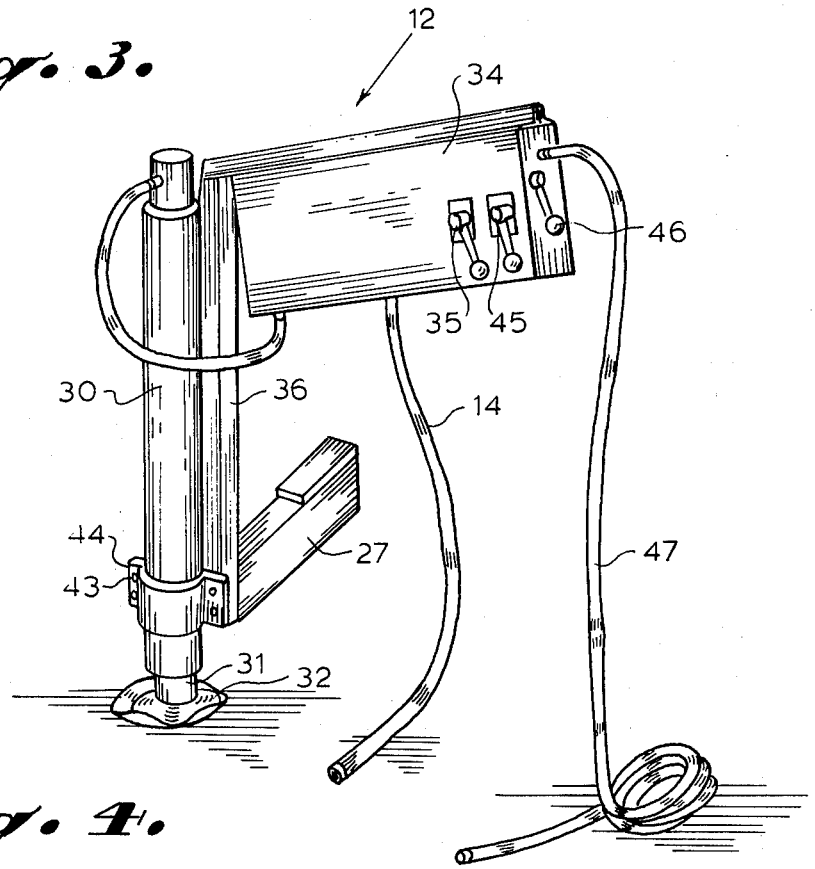
FIG. 3 is a perspective view of a jack in accordance with the present invention.

Turning now to FIG. 3, the jack 12 is seen having the hydraulic cylinder 30 attached to the arm 36 with a bracket 43 and bolts 44 with the arm 36 having the elongated arm 27 rigidly attached thereto, and the hydraulic power rod 31 being retracted into the hydraulic cylinder 30. The hydraulic power rod 31 has the foot 32 attached thereto and a hydraulic power line 33 connects the hydraulic cylinder 32 to a hydraulic fluid reservoir 34. The reservoir is powered by a pneumatic power line 14 which is connected to the pneumatic system of the truck or to a pneumatic pressure source at the factory. The reservoir 34 is actuated through valves in which a control 35 actuates the jacks in one direction while a control 45 actuates the jack in the opposite direction and the control 46 allows one jack to be adjusted relative to the other. Thus, all of the controls for one end of the modular unit 10 of FIG. 1 can be controlled from one corner by one operator. A hydraulic pressure line 47 is used to connect a hydraulic pressure line 48 of FIG. 4 for operating the jack 13 illustrated in FIG. 4. Jack 13 has the horizontally extending arm 28 having elongated shims 42 attached thereto, and is attached to the perpendicular extending arm 37. Arm 37 is attached by brackets 50 to the hydraulic cylinder 38 which is driven by line 48 to drive the hydraulic cylinder power rod 40 to drive the attached foot 41.

Figure 4:
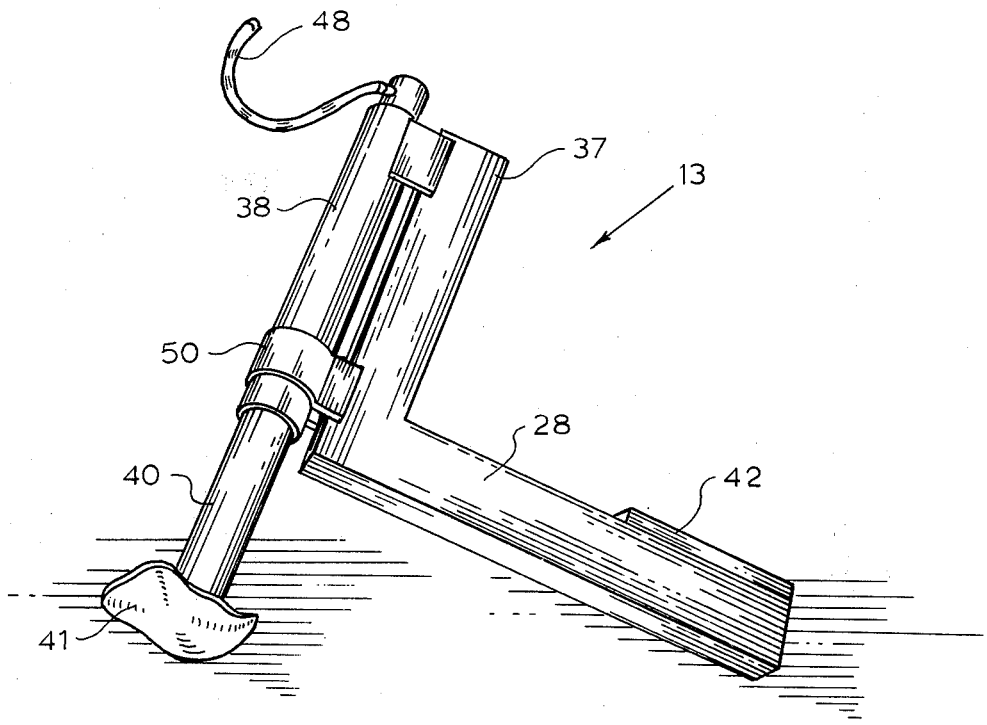
FIG. 4 is a perspective view of a second jack in accordance with the present invention.
Figure 5:
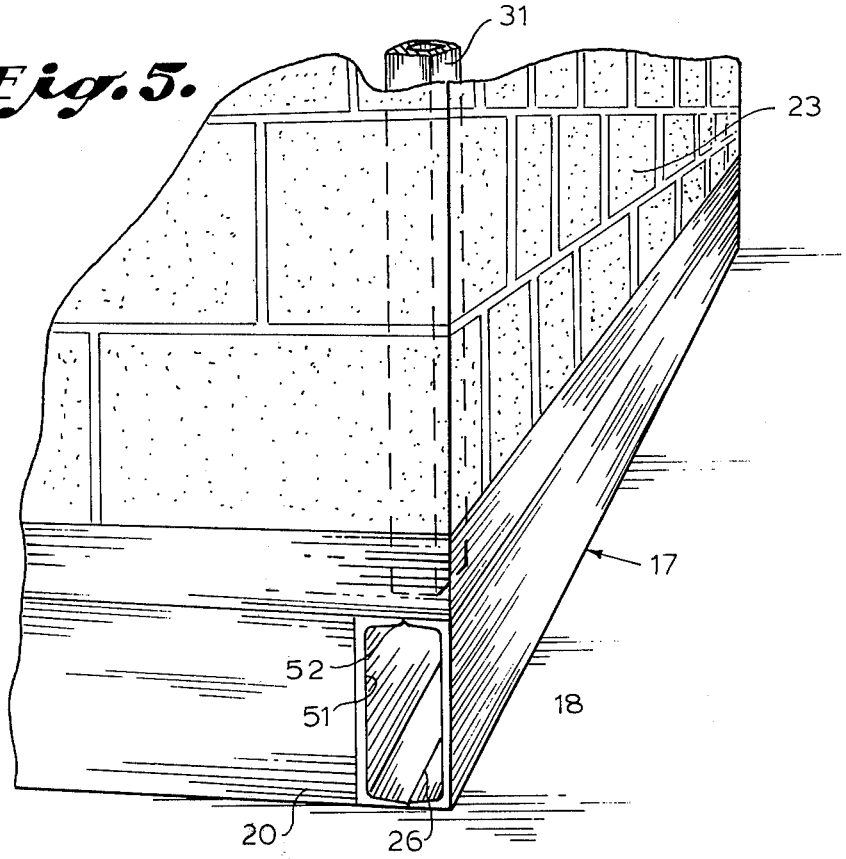
FIG. 5 is a cutaway perspective view of a portion of the modular unit for supporting the jack in accordance with the present invention.
Figure 6:
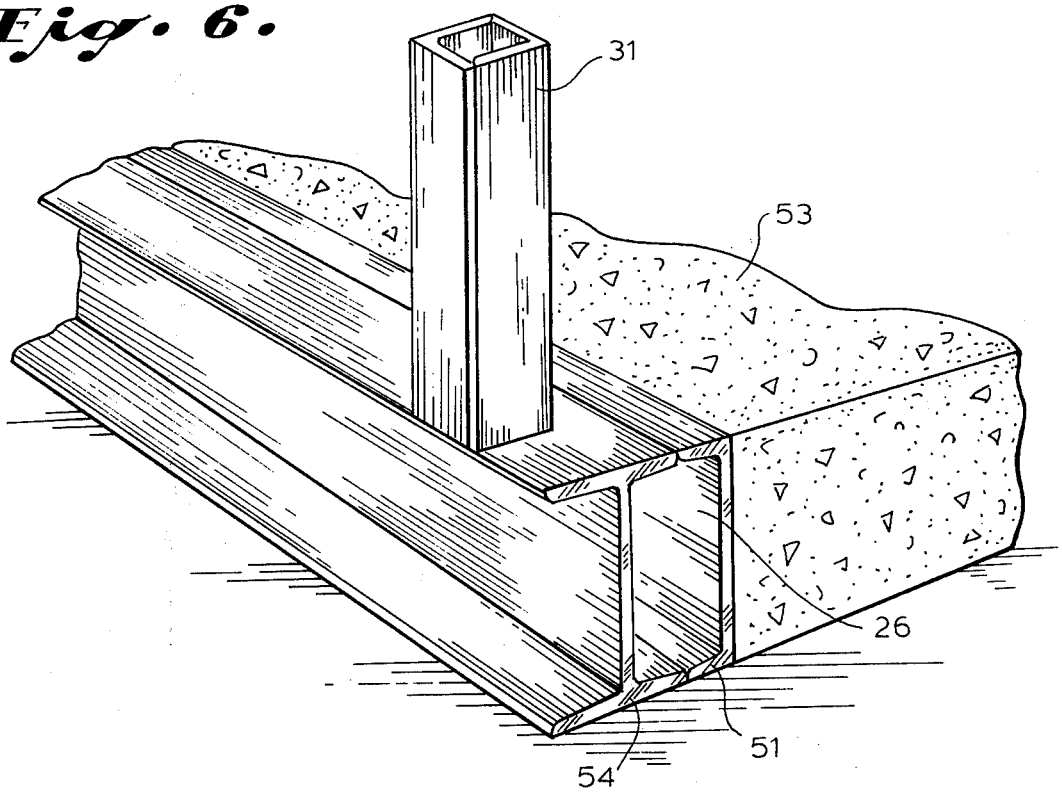
FIG. 6 is a cutaway perspective view of the corner framework of the modular unit.

Turning now to FIGS. 5 and 6, a better understanding of the elements that are incorporated into the building unit 10 in order to operate in connection with the jacks in FIGS. 3 and 4 is illustrated with the perimeter frame 17 having the side members 18 and transverse members 20. The perimeter members 18 are typically of heavy channel steel and may be formed of two U-shaped members 51 welded at 52 and having the opening 26 at each end thereof for excepting either the arm 27 of Jack 12 or the arm 28 of Jack 13. The jack would then spread the force through the arms 27 and 28 along steel channel members 17 and would apply the force directly under the vertically extending steel column 31. The perimeter frame 17 also supports the concrete block walls 23 as well as a poured reinforced concrete floor 53. FIG. 6 is a modified embodiment inasmuch as one U-shaped beam 51 is formed against an I-beam 54 to form the opening 26, and the vertical column 31 is attached to the I-beam 54. It should of course be clear that two I-beams could be utilized to produce the opening 26 for the jack. This embodiment allows two modular units that are to be attached together to form one larger building to be connected with the I-beam 54.

It should be clear at this point that a jacking and modular building unit transportation system has been provided which can advantageously move very heavy concrete block or formed concrete modular units which have incorporated the portions of the system necessary for the lifting of the modular units. The jacks for instance are contemplated as being driven pneumatically through pneumatic/hydralic actuators but it should be clear that air motors or even electrical motors operating from a 12 volt D.C. vehicle battery could be used to actuate the hydraulic system if desired. It should, however, be clear that other embodiments are comtemplated at being within the scope of the invention which is not to be construed as limited to the particular forms illustrated herein.

I claim:

1. A lifting system and modular building unit comprising in combination:

a movable, horizonal perimeter metal base frame adapted to have a modular unit built thereon and adapted to be lifted with the rest of the modular unit onto a vehicle for movement to a desired location, said base frame having a plurality of openings therein;

interconnecting metal framework members forming a modular unit framework with said base metal frame and including vertically extending metal reinforcing members fixedly attached to said base frame at one end thereof and to upper horizontal frame members at the other end thereof;

a poured reinforced concrete floor formed on said perimeter metal base and concrete block walls formed over said perimeter frame and interconnected with said interconnecting framework;

a pluality of removable fluid actuated jacks, each having an L-shaped bracket having a 1st elongated arm extending substantially perpendicular to said jack, and a second elongated arm extending parallel to said jack and being rigidly attached to said jack, said first arm having a predetermined cross-section for insertion into one of said plurality of openings in said perimeter base frame beneath at least one vertically extending metal reinforcing framework member whereby pressure applied to said perimeter frame by one said jack will apply pressure to said interconnecting metal framework members;

control means for controlling the operation of said jacks, said control means being mounted to one of said plurality of jacks for actuating said jack and at least one other of said plurality of jacks;

a fluid reservoir being attached to at least one said jack and being operatively connected to at least one other jack for operating said jacks responsive to said control means; and fluid pressure means for actuating said plurality of jacks said fluid pressure means being removably attached to said control means whereby a modular unit can be lifted by actuating said jacks for loading onto a vehicle and for removing said modular units from said vehicle.

2. The lifting system in accordance with claim 1 in which elongated arms on said jacks have shims thereon to apply forces at predetermined points.

3. The system in accordance with claim 1 in which said perimeter base frame is made of rectangular shaped channel steel forming a rectangular perimeter base frame.

4. The system in accordance with claim 1 in which said L-shaped brackets first arm extends perpendicular from each said jack and is attached approximately at the bottom of the jack hydraulic cylinder whereby lowering the hydraulic jack cylinder rod will allow the building lowered to the surface supporting the jack.

* * * * *